United States Patent [19]

Voight, III et al.

[11] Patent Number: 4,567,954

[45] Date of Patent: Feb. 4, 1986

[54] REPLACEABLE NOZZLES FOR INSERTION INTO A DRILLING BIT FORMED BY POWDER METALLURGICAL TECHNIQUES AND A METHOD FOR MANUFACTURING THE SAME

[75] Inventors: Robert W. Voight, III, Conroe, Tex.; Jerry L. Robin; Lorenzo G. Lovato, both of Salt Lake City, Utah; Robert J. Balkenbush, Kerns, Utah; Joseph D. McDermaid, Moore, Okla.

[73] Assignee: Norton Christensen, Inc., Salt Lake City, Utah

[21] Appl. No.: 557,431

[22] Filed: Dec. 2, 1983

[51] Int. Cl.[4] ..... E21B 10/60

[52] U.S. Cl. ..... 175/422 R; 175/374; 175/340; 175/393; 239/600; 249/59; 285/422; 419/18

[58] Field of Search ..... 175/422, 374, 409, 393, 175/339, 340; 249/59; 239/600; 419/18, 36, 37; 75/240; 285/422, 355, 390; 29/157 C

[56] References Cited

U.S. PATENT DOCUMENTS

| | | | |
|---|---|---|---|
| 971,516 | 10/1910 | Beaver | 239/523 |
| 2,955,847 | 10/1960 | McKenna | 285/422 |
| 3,982,778 | 9/1976 | Spencer et al. | 285/329 X |
| 4,442,909 | 4/1984 | Radtke | 175/329 |

*Primary Examiner*—James A. Leppink
*Assistant Examiner*—Hoang C. Dang
*Attorney, Agent, or Firm*—Beehler, Pavitt, Siegemund, Jagger & Martella

[57] ABSTRACT

Replaceable nozzles may be provided in a tungsten carbide drill bit manufactured by powder metallurgical infiltration techniques wherein at least one nozzle is threaded into a corresponding molded threaded bore in the bit. Despite the practical nonmachinability and brittleness of the tungsten carbide material, secure threaded insertion can be achieved if a squared thread design is used, and if the mold plug for forming the threaded bore is oversized to take into account the average variation in shrinkage in a bit formed by powder metallurgical infiltration techniques.

19 Claims, 9 Drawing Figures

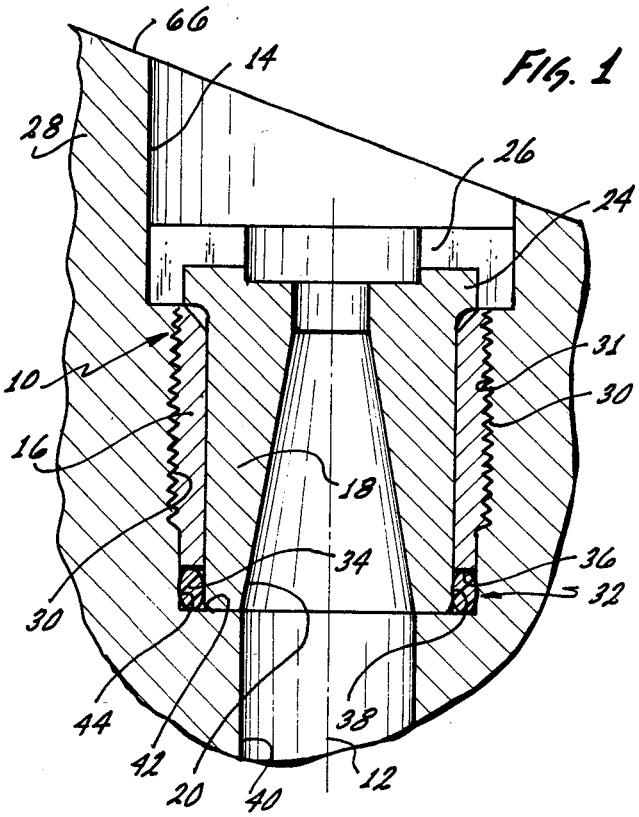
FIG. 1
FIG. 2
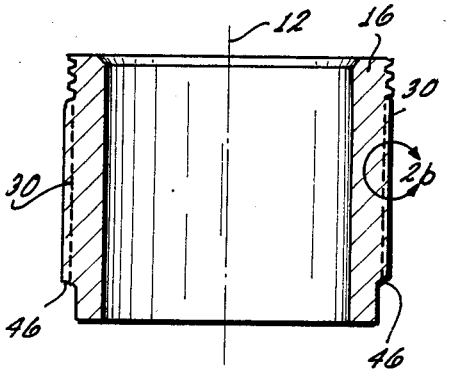
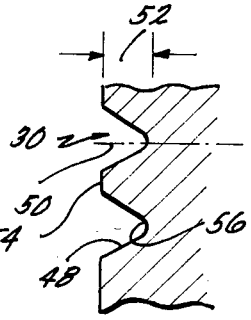
FIG. 3b
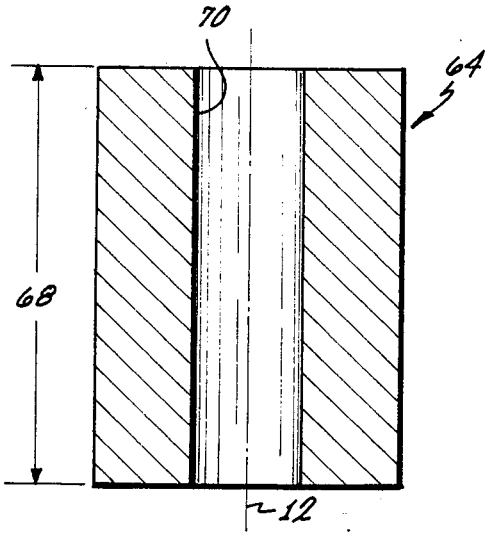
FIG. 4
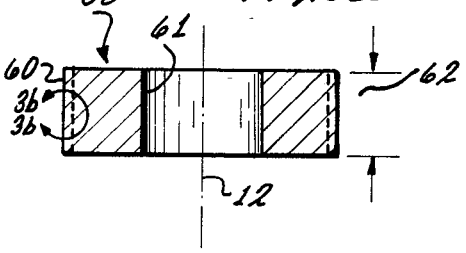
FIG. 3a

REPLACEABLE NOZZLES FOR INSERTION INTO A DRILLING BIT FORMED BY POWDER METALLURGICAL TECHNIQUES AND A METHOD FOR MANUFACTURING THE SAME

BACKGROUND OF THE INVENTION

1. Field of the Invention

The invention relates to the field of earth boring tools and more particularly to hydraulic nozzles which may be threadably inserted and replaced in rotating bits which are manufactured using powder metallurgical infiltration techniques.

2. Description of the Prior Art

A rotating drill bit is cooled and cleaned by drilling mud provided to the bit surface during the normal drilling operation. In some cases, the drilling mud is provided axially or through the bit face through a plurality of off-center crowfoot openings in the bit, each of which communicate with an axial bore defined in the bit to which drilling mud is supplied. The drilling mud flows out the crowfoot openings provided through the bit, flows across the bit surface up its gage and junk slots, and thence upwardly along the drill string carrying chips, debris and junk away from the drilling surface.

In certain applications, to obtain a directed flow or to provide high velocity jets of drilling fluid, the crowfoot openings may be replaced by one or more replaceable jet nozzles which are either molded into the steel drilling bit or may be inserted therein such as by means of a snap-ring retaining element. A jet nozzle has a specially formed orifice designed according to well understood principles to concentrate the drilling mud and to form a high velocity and directed output. In the case of steel bits, it is usually easiest and most economical to machine a threaded bore in the bit into which a nozzle may be threaded. Alternatively, a snap-ring retaining groove is machined in a drilled bore into which the replaceable nozzle is inserted and which is then retained by a retaining ring engaging the groove to prevent the nozzle from being blown out by the high pressure drilling mud.

However, it is not possible to practically manufacture a drilling bit incorporating diamond cutting elements in a steel bit. Typically, diamond bits are manufactured by powder metallurgical techniques using a tungsten carbide matrix. A conventional process is used wherein the bit is molded and the desired constituents of the matrix are infiltrated through the tungsten carbide powder during a furnacing step. However, such tungsten carbide material, although it is extremely hard and abrasive resistant, is highly brittle. Because of the hardness of the material, it becomes practically impossible to machine the material or to drill bores therethrough. In addition, because of the brittleness of the material, threads or other fine structures which may be molded into a tungsten carbide drilling bit thus formed, have insufficient strength to provide a secure attachment for threaded nozzles inserted into the bit. As a result, the threads tend to fail and the nozzles are eventually blown out of the bit when the means for their retention therein is lost. The drilling fluid entering the nozzle tends to erode the matrix material forming the bit about the entry point of the nozzle and therefore tends to erode the threads formed into the bit material. After sufficient erosion of the threads, the nozzle will be blown out from the bit.

Therefore, what is needed is a method whereby replaceable nozzles may be inserted and retained into a tungsten carbide bit without being subject to the foregoing disadvantages.

BRIEF SUMMARY OF THE INVENTION

The present invention is an improvement in a method for disposing hydraulic nozzles in a drill bit manufactured by powder metallurgical techniques wherein the bit is composed of a brittle material, typically tungsten carbide. The improvement comprises the step of molding a threaded bore into the drill bit using powder metallurgical techniques wherein the step of molding the threaded bore includes molding threads into the bore which threads are separated by a flat spacing between each thread.

The threaded bore is molded using an oversized mold plug which is compressible and removed from the drill bit after the step of molding the bore. The plug is removed from the furnaced bit. The oversized bore has then shrunk to a final predetermined size. The predetermined size corresponds and fits the designed size of a threaded insertable nozzle.

The invention further includes a nozzle and a drill bit formed by powder metallurgical techniques and composed of brittle material, such as tungsten carbide. The nozzle comprises a threaded bore defined in the bit wherein the bore is molded into the bit in an oversized dimension and shrunk to final dimension by furnacing the bit. A threaded nozzle is arranged and configured to threadably couple to the threaded bore and is disposed into the threaded bore wherein the threads of the threaded bore and threaded nozzle are squared by a flat spacing provided between each thread in the bore and on the nozzle.

The present invention and its various embodiments are better understood by considering the following drawings wherein like elements are referenced by like numerals.

BRIEF DESCRIPTION OF THE DRAWINGS

FIG. 1 is a cross-sectional view of a first embodiment of a replaceable nozzle disposed in a tungsten carbide bit.

FIG. 2 is a cross-sectional view taken through a plane including the longitudinal axis of the nozzle showing only the threaded sleeve portion as shown in FIG. 1.

FIG. 3*a* is a cross-sectional view taken through a plane including the longitudinal axis of the nozzle showing a mold plug for the threaded portion of the bore molded into the bit as shown in FIG. 1.

FIG. 3*b* is an enlargement of portion 3*b*—3*b* of FIG. 3*a*.

FIG. 4 is a cross-sectional view taken through a plane including the longitudinal axis of the nozzle showing a mold plug for the open end of the bore shown in FIG. 1.

Figure 5:
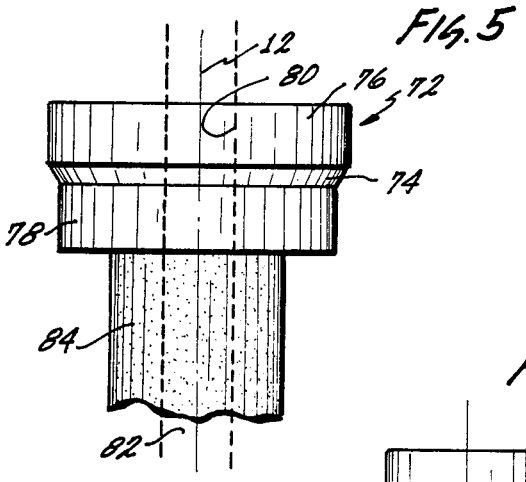
FIG. 5 is a cross-sectional view of a mold plug taken through the plane including a longitudinal axis of the plug for the lower end of the bore in FIG. 1.

These and other embodiments of the present invention may be better understood by considering the above Figures in light of the following detailed description.

DETAILED DESCRIPTION OF THE PREFERRED EMBODIMENTS

The present invention is a method of forming a threaded bore in the matrix material of a tungsten carbide bit formed using conventional powder metallurgical techniques so that a replaceable nozzle may be threaded into the threaded bore and securely retained therein despite the inherent brittleness of the tungsten carbide threads, despite the tendency for the drilling mud to erode the threads from the bore, and despite variable shrinkage inherently characterizing powder metallurgical bits formed by infiltration techniques. In particular, the threaded bore and the threaded nozzle are formed using open, squared threads. A static seal is provided at the bottom of the nozzle between the lower end and the bore defined in the bit thereby preventing erosion of the threads which lie above the static seal. The threaded bore is formed with an oversized molding plug chosen of such dimension such that when the bit is furnaced, the average shrinkage will bring the threaded bore within the designed tolerances.

Consider now the nozzle illustrated in FIG. 1 which is shown in cross-sectional view taken through a plane including the longitudinal axis of symmetry 12 of nozzle 10 and the bore defined in the bit in which nozzle 10 is disposed. The bore is generally referenced by numeral 14. Nozzle 10 includes a threaded, cylindrical metallic sleeve 16 disposed about the body of nozzle 10 which is integral and defines a funnel-shaped, axial inlet bore 20 leading to an outlet orifice 22 defined through a head portion 24. A tool slot 26 is defined across a diameter of nozzle 10. Sleeve 16 is coupled or fixed to integral body 18 of nozzle 10.

In the preferred embodiment, sleeve 16 is composed of a steel alloy whose thermal expansion of coefficient is chosen to approximate the thermal expansion coefficient of the matrix material of which the bit is composed. Similarly, body 18 and head portion 24 of nozzle 10 are generally formed of the same type of matrix material 28 which constitutes the bit in which nozzle 10 is disposed. Sleeve 16 is fixed to body 18 of nozzle 10 by means of brazing or other equivalent means well-known in the art. Threading 30 is defined on the outer circumferential surface of cylindrical sleeve 16 and engages internal threading 31 defined in bore 14, which threading 30 and 31 are described in greater detail in connection with FIGS. 2, 3*a* and 3*b*.

Body 18 and shoulder 24 of nozzle 10 are designed slightly out-of-round or eccentric to allow brazing material to sufficiently penetrate and fill the space between body 18 and circular cylindrical sleeve 16. However, as tight a fit as practical is required between the upper portion of bore 14 and shoulder 24 to prevent backwash erosion. The eccentricity of body 18 and shoulder 24, which might cause jamming during insertion, is avoided by the tolerance designed into threads 30 and 31 as described below.

Nozzle 10 is also provided with a static seal 32 which includes a conventional O-ring 34 disposed below lower end 36 of sleeve 16 and around the lower outer shoulder portion 38 of body 18. Thus, as depicted in FIG. 1, O-ring 34 is appropriately sized to tightly seal shoulder 38 of body 18 and lower end 36 of sleeve 16 against the adjacent portions of bore 14 defined in the bit. In particular, bore 14 includes a reduced diameter fluid bore 40 communicating with the main axial bore within the bit which supplies the drilling fluid to nozzle 10. Bore 14 increases in diameter to form a shoulder 42 at and adjacent to shoulder 38 of body 18, thereby defining an annular space within which O-ring 34 is disposed to form the static seal.

By reason of this combination of elements, drilling mud flowing through reduced diameter bore 40 into funnel-shaped bore 20 is sealed from threads 30 which are thereby protected from the erosive action of the drilling mud. Even in the case where the upper portion of reduced diameter bore 40 adajacent to the shoulder 38 of body 18 of nozzle 10 erodes away, O-ring 34 will tend to stay in place and protect threads 31 as long as it is able to contact and seal against circumferential annular surface 44 of the lower end of bore 14. Inasmuch as drilling fluid cannot flow across static seal 32 to any significant extent, erosion is substantially retarded such that drilling mud will first erode away body 18 and head 24 of nozzle 10, thereby requiring replacement of the nozzle static seal. Eventually, the cutting elements on the bit will have reached the limit of their useful life well before sufficient erosion has occurred to prevent the reestablishment of static seal 32 after nozzle replacement.

FIG. 2 is a cross-sectional view of sleeve 16 alone taken in the plane of FIG. 1. In the preferred embodiment, a lower edge 46 of threads 30 are chamfered at approximatly 45° to more gracefully accommodate O-ring 34 and assist the formation of an adequate static seal.

A portion of threading 60 of mold plug 58 corresponding to threads 31 of bore 14 is shown in enlarged scale in FIG. 3*b* and illustrates the open, square threading formed in both sleeve 16 and bore 14 according to the invention. The slope of the thread faces 48 of internal threading 31 is approximately 30° relative to the radius 50 with a threading depth 52 in the mold plug 58 shown in FIG. 3*b* of 1.07 mm (0.0420 inch). In the following description the dimensions shall be set forth in terms of mold plug 58 of FIG. 3*b* and mold plug threading 60 which is used to form threads 31 in bore 14 and which engage similarly shaped and dimensioned sleeve threads 30. Actual dimensions of threads 31 in bore 14 will vary due to shrinkage of bore 14 during furnacing as described below. The depth is defined as the distance from the flat 54 of threading 30 to its outer point 56. Again, in the illustrated embodiment, a pitch of twelve threads per inch (4.7 threads per cm) has been selected, although other thread pitches could have been alternatively chosen.

Tungsten carbide material is extremely brittle, particularly when formed with a sharp radius. Normally, crack propagation will begin first at sharp corners. Therefore, mold threads 60 of the invention defined in mold plug 58 of FIG. 3*b* are designed to avoid this inherent brittleness by the use of a gentle radius of approximately 0.127 mm (0.005 inch) for point 56 and by the use of flats 54 between threads 30. Flat 54 in the illustrated embodiment is approximately 0.885 mm (0.035 inch) wide in mold plug 58 or slightly less than the basal width of mold thread 60 which is approximately 1.23 mm (0.048 inch). The angle between flat 54 and thread face 48 is thereby increased to 120° from the 60° intersection which would have been the case if faces 48 were allowed to join at a point intersection as in conventional threading. In addition, a certain amount of plug deterioration is to be expected during furnacing so that the sharp intersection between faces 58 and flat 54 depicted in FIG. 3*b* is not actually formed. Moreover, the matrix material will not completely fill the threads so that internal threading 31 in bore 14 will be approximately 75% of the depth indicated in FIG. 3*b*. FIG. 3*b* and the dimensions set forth above for flat 54 therefore should be understood as the ideal or maximum and internal threads 31 may be slightly different. More particularly, actual thread depth of threads 31 corresponding to mold plug threads 60 will be approximately 0.800 mm (0.0315 inch). Meanwhile, threads 30 in steel sleeve 16 have a thread depth of 1.029 mm (0.0405 inch) providing a relatively loose 0.229 mm (0.009 inch) clearance. However, the thread is coarse and open enough to still provide sufficient holding strength. Many other dimensions and proportions could be chosen without departing from the scope of the invention.

Consider now the form of bore 14 and the manner in which bore 14 is formed in the method of the invention. Turning to FIG. 3*a*, a cross-sectional view taken through the plane in which longitudinal axis 12 lies is shown for a mold plug thread ring 58. Mold plug 58 is formed of graphite or other suitable plug material and includes threading 60 formed on the exterior thereof having a shape described above in connection with FIG. 3*b*. Thickness 62 of plug 58 in the illustrated embodiment is approximately 13.7–13.5 mm (0.54–0.53 inch). An axial bore 61 is defined through ring 58 through which a graphite rod 82 will later be disposed as described in connection with FIG. 6.

The diameter of thread plug 58 as measured from root to root on threading 60 is 25.5 to 25.0 mm (1.002 to 0.984 inch) while the diameter of sleeve 16 as measured from point to point is 27.0 to 26.6 mm (1.061–1.049 inch). Shrinkage in the radial direction of bore 14 during furnacing will open bore 14 so that threads 31 formed from threads 60 of mold plug 58 will engage threads 30 of sleeve 16 and still allow sufficient tolerance.

Turn to FIG. 4 wherein a cylindrical mold plug 64 is shown in cross-sectional view taken through the plane of FIG. 1 which mold plug 64 forms the upper open end of bore 14 accommodating head 24 and communicating nozzle 10 with the bit face 66. Again, in the illustrated embodiment, the height of mold plug 64 is approximately 25.4 mm (1 inch) and includes an axial bore 70 through which a connecting graphite rod 82 is later disposed as shown in FIG. 6.

Turning now to FIG. 5, an end mold plug 72 is illustrated again in cross-sectional view taken in the plane of FIG. 1. End mold plug 72 including longitudinal axis 12 forms the lower end portion of bore 14, namely, shoulder 42 of bore 14 described in connection with FIG. 1. Thus, a 30° chamfered slope 74 is provided between an upper portion 76 having a first diameter in the illustrated embodiment of 25.0–25.5 mm (0.984–1.002 inch) and a lower portion 78 having a diameter of 18.8–24.8 mm (0.74–0.976 inch). An axial bore 80 is formed through plug 72 with the same diameter as axial bores 70 and 61 and through which graphite rod 82 is disposed when the plug portions are assembled, including cylindrical sand molding 84 built up in a conventional manner about graphite rod 82 to form reduced diameter portion 40 of bore 14 which ultimately communicates with the main axial supply conduit (not shown) in the bit.

Figure 6:
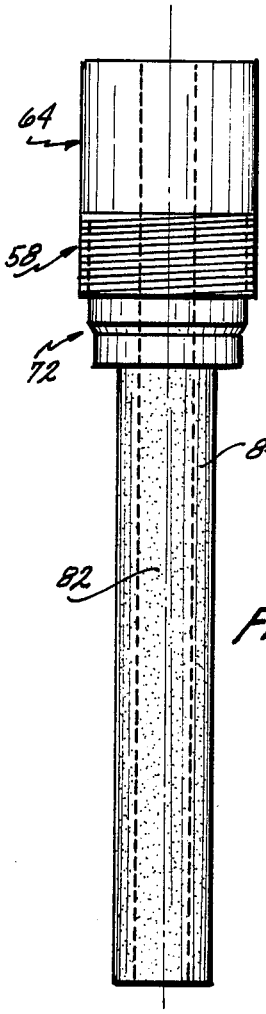
FIG. 6 is a side elevational view of the assembled mold plug from the components shown separately in FIGS. 3–5.

Turn now to FIG. 6 wherein the mold plugs of FIGS. 3–5 are assembled and shown in side elevational view. As shown, plugs 64, 58 and 72 are assembled on graphite rod 82 together with sand molding 84 to form a completed plug which is inserted in the bit mold and around which the powder metal is poured or packed prior to furnacing. The loaded bit mold together with the assembled nozzle plugs as shown in FIG. 6 is then furnaced allowing the binder material to infiltrate through matrix powder loaded in the mold. The nozzle plugs of FIG. 6 are then removed, or sandblasted out. The graphite material of the plugs is porous and therefore compressible. As the bit cools and shrinks, the graphite plugs are compressed where appropriate to the final predetermined size of the bore.

The amount of shrinkage which will occur in a bit depends at least upon the composition of the matrix material of which the bit is formed and will vary from one batch to another. Shrinkage is not uniform in direction within a bit and will depend on distribution of matrix particle sizes and nature, bit design, mold design, temperature and humidity. For example, a matrix composition of one type is used on the bit face and another type is used in the core of the bit; the bit will also include a steel shank and a plurality of other mold plugs and cutting elements, each of which have different shrinkage characteristics; the mold is usually made of different types of materials and is built in different sections each of which may have different shrinkage characteristics; gravitational loading through the matrix powder is not uniform among all bits; temperature distribution within all of the above elements is nonuniform; particle settling and binder mixture is also nonuniform. All of these nonuniformities and others cause the amount of shrinkage to vary from bit-to-bit and from run-to-run and to be nonuniform in direction in any given case. Therefore, according to the invention, each of the plug parts shown and described in connection with FIGS. 3–5 are chosen to be oversized with respect to the desired dimensions of bore 14 when finally cured in order to provide the design tolerances for threading 30 of nozzle 10 and threading 31 of bore 14. Manufacture of the nozzle plug in an oversized dimension larger than necessary will lead to a loose fit and loss of static seal 32 whereupon threads 30 will be eroded and nozzle 10 blown out of the bit. The use of an undersized plug, which would include a plug substantially the same dimensions as nozzle 10 results in a bore 14 too small and into which nozzles 10 cannot be inserted or which will bind and cannot be removed. Bore 14 cannot easily be machined or enlarged due to the hardness and inherent nonmachinability of the tungsten carbide material constituting matrix material 28 of the bit, if a tight fit is obtained.

Therefore, in the illustrated embodiment wherein threaded ring plug 58 of FIGS. 3*a* and 3*b* have an outer diameter of 27.5–27.6 mm (1.081–1.086 inch) at flats 54 of threads 60 in plug 58 corresponding to the flats of threads 31, and a diameter of 25.0–25.5 mm (0.984–1.002 inch) at point 56 of the threads 60 corresponding to the points of threads 31 for a total thread depth of 0.991–1.30 mm (0.039–0.51 inch). However, the outer diameter of metallic sleeve 16 shown in FIG. 2 is 26.6–26.9 mm (1.049–1.061 inch) thereby anticipating a diametrical shrinkage of bore 14 by 0.635 mm (0.025 inch) or approximately 2.3%. In other words, in the illustrated embodiment, the threading depth of threads 60 of 1.067 mm (0.0420 inch) will shrink approximately to 0.790 mm (0.0311 inch), substantially comparable to 2.13–2.46 mm (0.84–0.097 inch) thread depth for threads 30 machined into sleeve 16.

It must be clearly understood that specific numerical dimensions have been cited in the illustrated embodiment only to illustrate the invention and these values should not be taken as defining or limiting the invention which can be applied to nozzles of other sizes and shrinkage rates characteristic of various types of matrix material.

Figure 7:
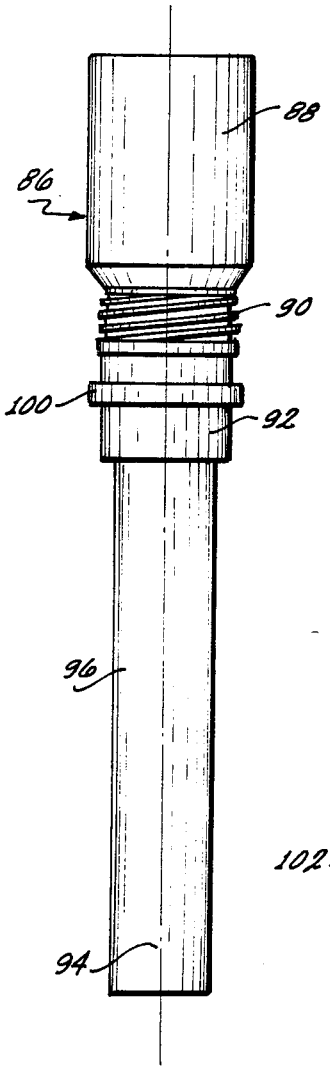
FIG. 7 is an assembled mold plug of a second embodiment of the bore formed in the bit.

Turning now to FIG. 7, a second embodiment of the invention is shown in side elevational view, wherein a mold plug, generally denoted by reference numeral 86, is depicted. As before, mold plug 86 includes an open end plug 88 corresponding to plug 64 of FIG. 4, a ring plug 90 corresponding to ring plug 58 of FIG. 3*a* and a lower end plug 92 corresponding to end plug 72 of FIG. 5. The assembly is aligned and mounted about an axially extending carbon rod 94 including a cylindrically packed sand cylinder 96 in the same manner as described above. The same type of threading is included on threaded ring plug 90 as was described in connection with threaded ring plug 58 in the embodiment of FIG. 6. However, lower end plug 92 differs from end plug 72 by including a first collar 98 which will form a first annular groove 106 defined in the bore for retention of a snap-ring 114 and a second annular groove 108 which similarly defines an angular groove in the bore for retention of a O-ring seal 110.

Figure 8:
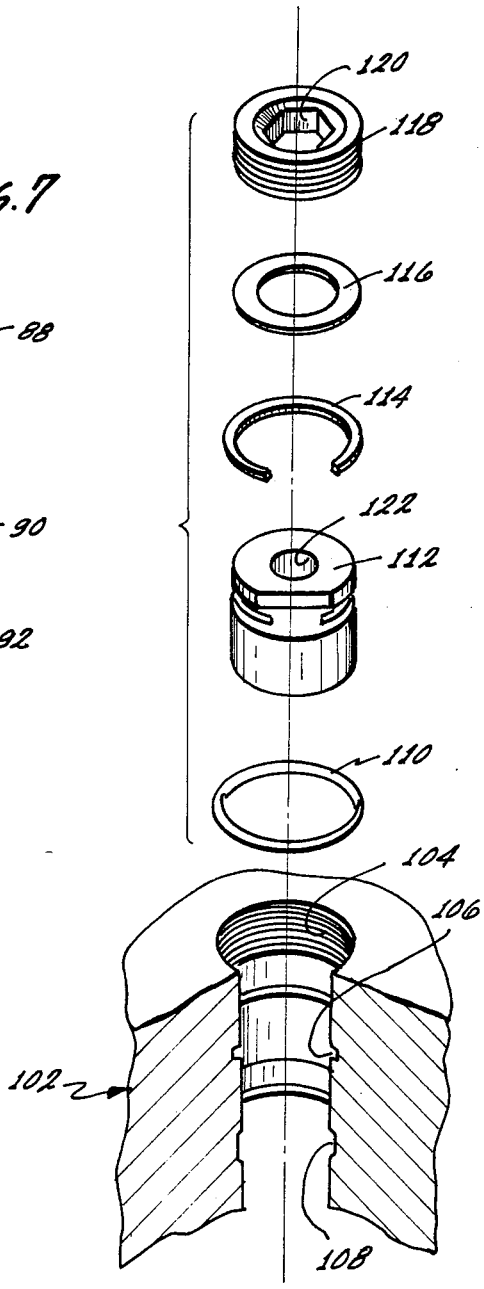
FIG. 8 is an exploded view of a nozzle for disposition within a bore molded using the plug shown in FIG. 7 and as diagrammatically depicted in the exploded view of FIG. 8.

Turning now to FIG. 8, a nozzle of the type adapted for disposition within a bore formed by plug 86 as shown in FIG. 7 is illustrated in exploded view. The bore, generally denoted by reference numeral 102, is shown in a diagrammatic form in the lower portion of FIG. 8 and particularly shows a threaded portion 104, snap-ring groove 106 and O-ring groove 108 which are formed by the corresponding portions 90, 98 and 100 respectively of plug 86 of FIG. 7. O-ring 110 is a conventional ring sized for disposition within O-ring groove 108 thereby sealing a conventional, one-piece tungsten carbide nozzle 112 to bore 102. O-ring 110 thus helps to prevent erosion of the sides of the bore and in particular, those portions in the vicinity of snap-ring groove 106, which erosion may ultimately cause a loss of snap-ring 114 disposed in groove 106 and above nozzle 112. A nylon washer 116 is then disposed above snap-ring 114 and an erosion nut 118 threaded into threaded portion 104 of bore 102 to protect the top of the bore and nozzle from backwash and erosion from the drilling mud. Erosion nut 118 is composed of a hard-faced steel and is highly abrasion resistant. Nut 118 is further provided with an axial, hexagonal aperture 120 having a larger diameter than orifice 122 defined in nozzle 112 so that orifice 122 remains the defining orifice with respect to the drilling mud and hexagonal aperture 120 is provided only as a means for insertion of a tool for securing nut 118 into threaded portion 104 of bore 102.

A snap-ring nozzle 112 of the type illustrated in the second embodiment of FIG. 8 is a conventional nozzle sold as a shrouded nozzle by Hughes Tool Company in various sizes, such as Part No. 78 0 74. However, conventional nozzle 112 is protected and retained within the bit and protected by erosion nut 118 which is threaded into threaded portion 104 of bore 102. Threaded portion 104 is molded into the matrix material of the bit in the same manner as described above in connection with the first embodiment of FIGS. 1–6, by using the mold plug 86 of FIG. 7 wherein appropriately oversized open and squared threading is formed on plug 86 to accommodate the average shrinkage of matrix material.

Many modifications and alterations may be made by those having ordinary skill in the art without departing from the spirit and scope of the present invention. As previously discussed the dimensions and shrinkage factors will vary from one application to another and from one matrix composition to another. These variations can be accommodated according to the teachings of the invention, even though they substantially depart from the dimensions and shrinkage set forth in the illustrated embodiments. Therefore, it must be clearly understood that the illustrated embodiment is shown only by way of example and for clarification and is not intended to limit the invention as defined in the following claims.

We claim:

1. An improvement in a method of disposing threaded hydraulic nozzles in a drill bit manufactured by powder metallurgical techniques wherein said bit is composed of a brittle material, said improvement comprising the step of molding a threaded bore into said drill bit using said powder metallurgical techniques wherein said step of molding said threaded bore includes molding threads therein separated by a flat spacing between each thread.

2. The improvement of claim 1 where in said step of molding said threaded bore is molded using an oversized mold plug removable from said drill bit after said step of molding to compensate for nonuniform shrinkage in said bit.

3. The improvement of claim 2 where in said step of molding, said brittle material is particulate in nature and partially forms said threads in said threaded bore, whereby nonuniform shrinkage of said bit is accommodated and wherein said hydraulic nozzles are characterized by having a threaded body and where by any eccentricity in the threaded body of said hydraulic nozzle is accommodated by looseness of threaded engagement of said nozzle with said threaded bore.

4. An improvement in a drill bit formed by powder metallurgical techniques and composed of a brittle material comprising:

a threaded bore defined in said bit, said bore first defined into said bit in an oversized dimension and then shrunk to a final dimension by furnacing said bit; and a threaded nozzle arranged and configured to threadably couple to said threaded bore and disposed in said threaded bore, wherein said threads of said threaded bore are squared by a flat spacing provided between each thread in said bore.

5. The improvement of claim 4 wherein said nozzle comprises a threaded sleeve having threads defined therein, and a body portion said sleeve being coupled to said body portion of said nozzle.

6. The improvement of claim 5 wherein said body of said nozzle includes an orifice and is composed of a hard material resistant to hydraulic erosion.

7. The improvement of claim 5 wherein said body portion of said nozzle is fixed to said threaded sleeve, said threaded sleeve being composed of steel alloyed to approximately equal the thermal coefficient of expansion of said brittle material composing said threaded bore of said bit.

8. The improvement of claim 7 wherein said hard material composing said body portion of said nozzle is the same as said brittle material composing said bit.

9. The improvement of claim 8 wherein said nozzle includes an orifice further comprising a static seal being disposed in a shoulder, said shoulder defined by the end of said threaded sleeve distal from said orifice of said nozzle and by a portion of said nozzle extending beyond said sleeve, whereby said static seal is tightly pressed by said shoulder against adjacent and opposing portions of said bore molded into said bit.

10. An improvement in a method of disposing hydraulic nozzles in a drill bit manufactured by powder metallurgical techniques wherein said bit is composed of a brittle material, said improvement comprising the step of molding a threaded bore into said drill bit using said powder metallurgical techniques wherein threads formed having points and roots characterized by a radius of curvature, said threads formed during said step of molding being formed with the points and roots of said threads, each point and root with a low radius of curvature, whereby crack propagation at sharp radii of curvatures through said brittle material of which said bit is composed is substantially avoided.

11. The improvement of claim 10 wherein said step of molding said threads in said threaded bore is effected by using a mold plug having a negative threaded bore defined therein, threads on said negative threaded bore being separated at the root of said threads by a flat spacing between each thread.

12. The improvement of claim 11 wherein said mold plug is oversized with respect to a final predetermined size of said threaded bore molded into said drill bit, the degree of oversizing of said mold plug and threaded bore defined thereon arranged and configured to compensate for nonuniform shrinkage of said bit when molded by use of said powder metallurgical techniques.

13. The improvement of claim 10 wherein said step of molding said threads into said threaded bore is effected through use of a mold plug having a negative bore defined therein, said mold plug is oversized with respect to a final predetermined size of said threaded bore molded into said drill bit, the degree of oversizing of said mold plug and threaded bore defined thereon arranged and configured to compensate for nonuniform shrinkage of said bit when molded by use of said powder metallurgical techniques.

14. An improvement in a drill bit formed by powder metallurgical techniques composed of a brittle material comprising:

a threaded bore defined in said bit, said bore being molded into said bit, said threads defined in said threaded bore including a point and root each characterized by a radius of curvature, each said point and root of each thread formed to have a low radius of curvature, whereby crack propagation in said brittle material at locations of high radii of curvature is substantially avoided.

15. The improvement of claim 14 wherein said threads defined in said threaded bore are molded into said bit with a rounded point and a flat spacing defined in said threaded bore between said root of each adjacent thread.

16. The improvement of claim 15 further including a threaded nozzle arranged and configured to threadably couple to said threaded bore, said nozzle being disposed in said threaded bore, said nozzle having an eccentric shape, said threaded bore loosely engaging said nozzle after achieving said predetermined size so that said eccentricity of said nozzle is accommodated by looseness of coupling with said threaded bore thereby allowing said nozzle to be smoothly disposed into said bit.

17. The improvement of claim 16 wherein said threaded nozzle includes a threaded circular cylindrical sleeve in which said threads of said nozzle are defined, said nozzle being eccentrically formed with respect to said sleeve whereby said sleeve is securely brazed to said nozzle, brazing material being disposed in a space defined said eccentrically shaped nozzle and said sleeve.

18. The improvement of claim 14 wherein said threaded bore is defined in said bit by molding and use of a mold plug, said mold plug having threads defined thereon, each thread on said mold plug having a rounded root adjacent to the next thread and a truncated point defining a flat space at said point of each thread.

19. The improvement of claim 18 wherein said mold plug is oversized and wherein said bit is furnaced by said powder metallurgical techniques thereby shrinking said bit, the degree of oversize of said mold plug being chosen to be substantially equal in each direction to the average corresponding shrinkage of said threaded bore defined said bit for each corresponding direction, whereby said mold plug is arranged and configured to compensate for shrinkage within said bit during furnacing to accommodate nonuniform directional shrinkage of said bit.

* * * * *